US010472757B2

(12) United States Patent
Biancalani et al.

(10) Patent No.: US 10,472,757 B2
(45) Date of Patent: Nov. 12, 2019

(54) VIBRATING APPARATUS FOR TREATMENT OF FABRICS

(71) Applicant: BIANCALANI S.R.L., Prato (IT)

(72) Inventors: Massimo Biancalani, Prato (IT); Riccardo Ravagli, Pistoia (IT)

(73) Assignee: BIANCALANI S.R.L., Prato (IT)

( * ) Notice: Subject to any disclaimer, the term of this patent is extended or adjusted under 35 U.S.C. 154(b) by 138 days.

(21) Appl. No.: 15/508,435

(22) PCT Filed: Sep. 9, 2015

(86) PCT No.: PCT/IB2015/056903

§ 371 (c)(1),
(2) Date: Mar. 2, 2017

(87) PCT Pub. No.: WO2016/038551

PCT Pub. Date: Mar. 17, 2016

(65) Prior Publication Data

US 2017/0254008 A1 Sep. 7, 2017

(30) Foreign Application Priority Data

Sep. 9, 2014 (IT) ..... PO2014U0011

(51) Int. Cl.
*D06B 3/20* (2006.01)
*D06C 19/00* (2006.01)
*D06B 23/14* (2006.01)

(52) U.S. Cl.
CPC ..... *D06B 3/206* (2013.01); *D06B 23/14* (2013.01); *D06C 19/00* (2013.01)

(58) Field of Classification Search
CPC ..... D06C 19/00; D06C 7/02; D06C 29/00; D06B 3/205; D06B 3/206; D06B 3/208;
(Continued)

(56) References Cited

U.S. PATENT DOCUMENTS 2,277,511 A * 3/1942 Daneke ..... B65H 31/40 271/210
3,594,914 A * 7/1971 Kutsuki ..... D06C 7/02 26/18.5

(Continued)

FOREIGN PATENT DOCUMENTS

DE 912 447 5/1954
EP 2 373 838 B1 9/2014

(Continued)

OTHER PUBLICATIONS

International Search Report and Written Opinion of the International Searching Authority for corresponding International Patent Application No. PCT/IB2015/056903 dated Dec. 23, 2015, 8 pgs.

*Primary Examiner* — Amy Vanatta
(74) *Attorney, Agent, or Firm* — Merchant & Gould P.C

(57) ABSTRACT

A vibrating apparatus for dimensional stabilization treatment of fabrics includes a fabric-containing tub (2), a vibration-generating slider-crank mechanism (3) and a support mechanism (4) for supporting the tub (2) and transferring the vibrations produced by the generating mechanism (3). The tub (2) is made of carbon fiber and the mechanism (4) for supporting and transferring vibrations includes at least three rocker arms (12), each having one end hinged to the tub (2), the other end hinged to a counterweight (6) located opposite to the tub (2) and being hinged in the middle to a load-bearing structure (16).

6 Claims, 3 Drawing Sheets

(58) Field of Classification Search
CPC ..... D06B 23/14; D06B 15/06; F26B 13/10; B65H 31/38; B65G 2812/03; B65G 2812/0312
See application file for complete search history.

(56) References Cited

U.S. PATENT DOCUMENTS

| | | | | | |
|---|---|---|---|---|---|
| 4,219,942 | A * | 9/1980 | Coliva | F26B 13/101 | 26/18.5 |
| 4,773,133 | A * | 9/1988 | Voisin | D06C 7/00 | 26/18.5 |
| 6,103,211 | A * | 8/2000 | Matsuhisa | D01F 6/18 | 423/447.1 |
| 2011/0083944 | A1* | 4/2011 | Bonn | B65G 27/04 | 198/766 |
| 2011/0232053 | A1* | 9/2011 | Biancalani | D06B 15/06 | 28/100 |
| 2013/0012849 | A1* | 1/2013 | Seaton | A61H 1/005 | 601/24 |
| 2015/0336745 | A1* | 11/2015 | Groenewald | B65G 27/12 | 198/750.8 |
| 2017/0022771 | A1* | 1/2017 | Frazier | B07B 13/16 | |

FOREIGN PATENT DOCUMENTS

| | | | |
|---|---|---|---|
| FR | 1 024 514 | A | 4/1953 |
| WO | 2010/064130 | A2 | 6/2010 |

* cited by examiner

VIBRATING APPARATUS FOR TREATMENT OF FABRICS

This application is a National Stage Application of PCT/IB2015/056903, filed 9 Sep. 2015, which claims benefit of Serial No. PO2014U000011, filed 9 Sep. 2014 in Italy and which applications are incorporated herein by reference. To the extent appropriate, a claim of priority is made to each of the above disclosed applications.

TECHNICAL FIELD

The present invention concerns a vibrating apparatus for treatment of fabrics, particularly for dimensional stabilization treatment of knitted fabrics during drying.

PRIOR ART

A novel type of industrial treatment for ensuring dimensional stability of knitted fabrics has been recently introduced in the textile industry.

This treatment method uses a vibrating platform in combination with a system for moving and progressively drying the fabric to obtain significant permanent dimensional shrinkage of the knitted fabric, such that the fabric becomes dimensionally stable even after repeated washing cycles in domestic washing machines.

Machines of this type are disclosed, for instance, in EP2373838, by the applicant hereof.

These machines basically have a structure comprising a tub containing the fabrics being treated, a mechanical vibration-generating mechanism and a tub-supporting system, which receives the vibrations from the generating mechanisms and transfers them to the tub and the fabric contained therein.

In these machines, the tub and the support system are made of steel and the remarkable stresses induced by inertial forces—caused by accelerations with intensities in multiples of gravity—make it very difficult to achieve a fair compromise between light-weight and strength requirements.

As the weight of the tub is increased, for example for strengthening and capacity-increasing purposes, all the control and support members of the apparatus must be accordingly increased in both mass and strength.

A vicious cycle is thus established, which actually leads to the impossibility both of further increasing the capacity of the vibrating tub, and of increasing the frequency and amplitude of oscillations.

This will make it very difficult to increase the throughput of the apparatus both in batch mode and, even more so, in continuous mode.

Beyond certain limits, the costs and dimensions are a major obstacle.

DISCLOSURE OF THE INVENTION

Therefore, the object of the present invention is to provide a vibrating apparatus for treatment of fabrics, particularly knitted fabrics, that obviates the above mentioned drawbacks and has higher capacities and performances than the prior art.

This object is fulfilled by a vibrating apparatus as defined in the appended claims. The characteristics and advantages of the present invention will be more clearly understood upon reading of the following description and the annexed drawings, which are given as a non limiting exemplary embodiment.

EMBODIMENT OF THE INVENTION

In the accompanying drawings, numeral 1 generally designates a vibrating apparatus 1 for use in the dimensional stabilization treatment of fabrics, particularly knitted fabrics, during drying.

Figure 1:
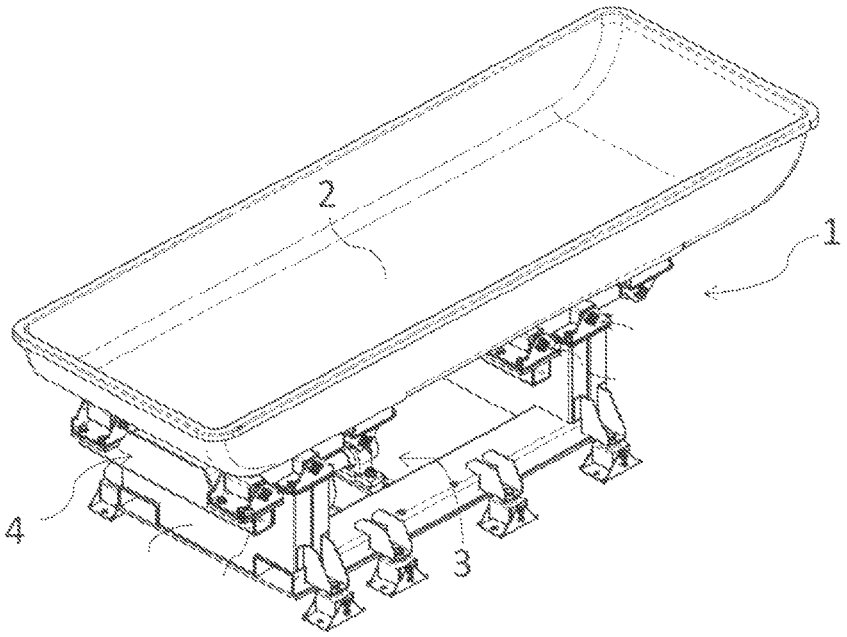
FIG. 1 is an axonometric view of the vibrating apparatus, in foreshortened form and shown as a whole.

The apparatus 1 basically comprises [FIG. 1] a tub 2 containing the fabrics being treated, a tub-supporting system 4 and a slider-crank mechanism 3 for controlling tub vibrations.

According to the invention, the tub 2 is made of carbon fiber, such that it may have a very high strength, e.g. much higher than steel, with much lower specific mass as compared with the latter.

Figure 2:
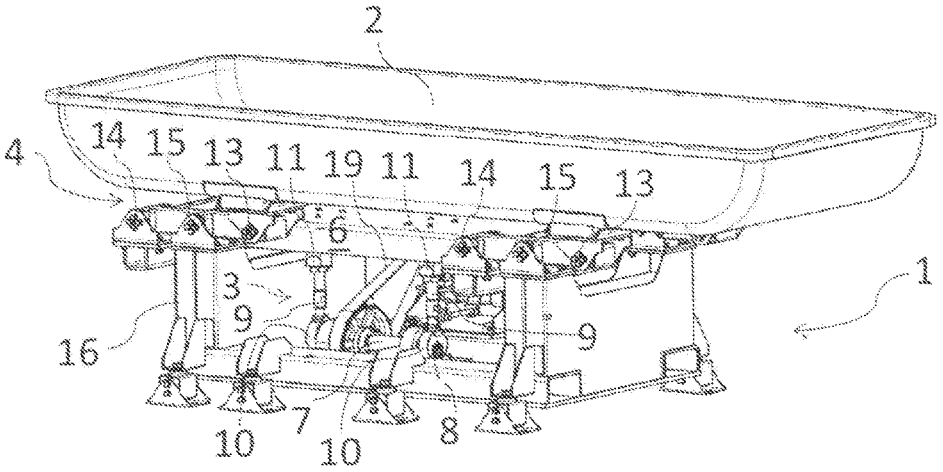
FIG. 2 is an axonometric view of the apparatus of FIG. 1, as viewed from one side to better show certain details thereof.
Figure 3:
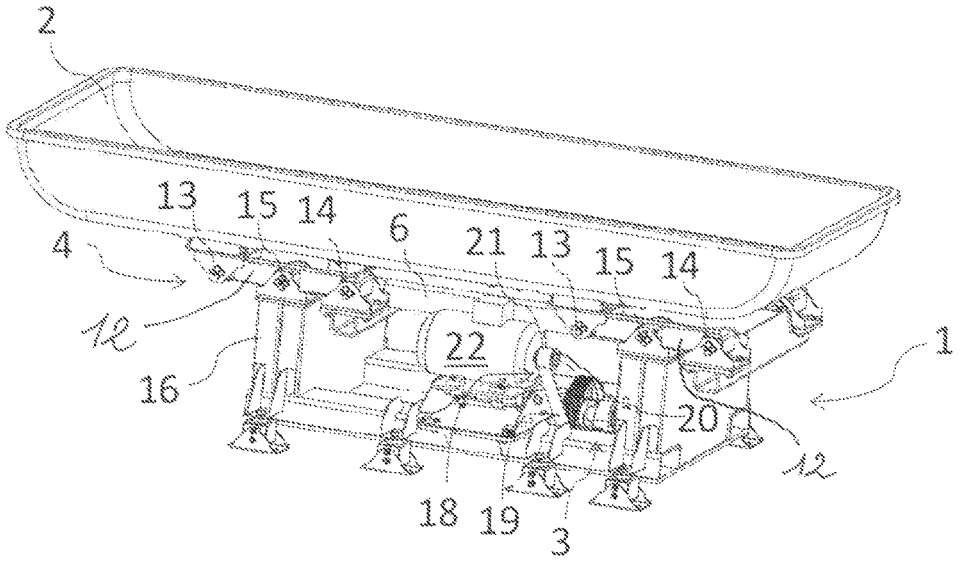
FIG. 3 is an axonometric view of the apparatus as viewed from the side opposite to that of FIG. 2.
Figure 4:
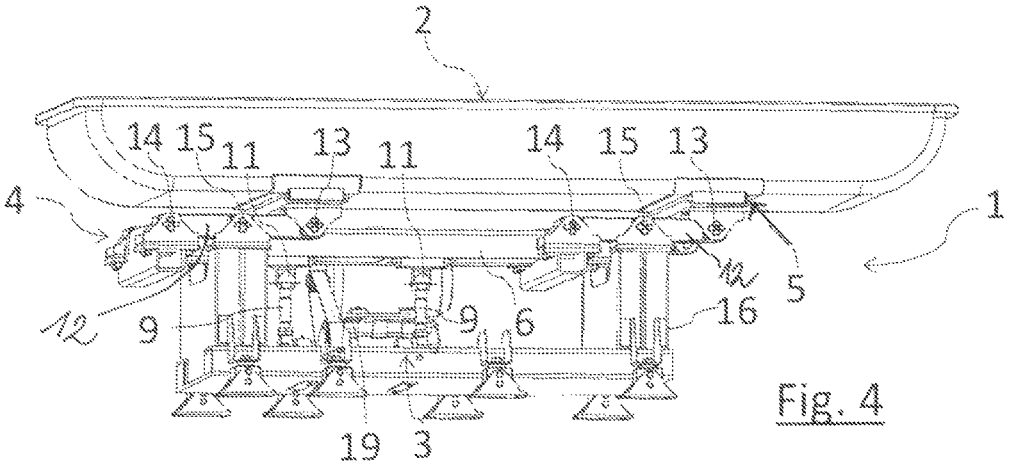
FIG. 4 is an axonometric view of the apparatus of FIG. 2, as viewed from one side and from the bottom to better show certain details that would be otherwise concealed.
Figure 5:
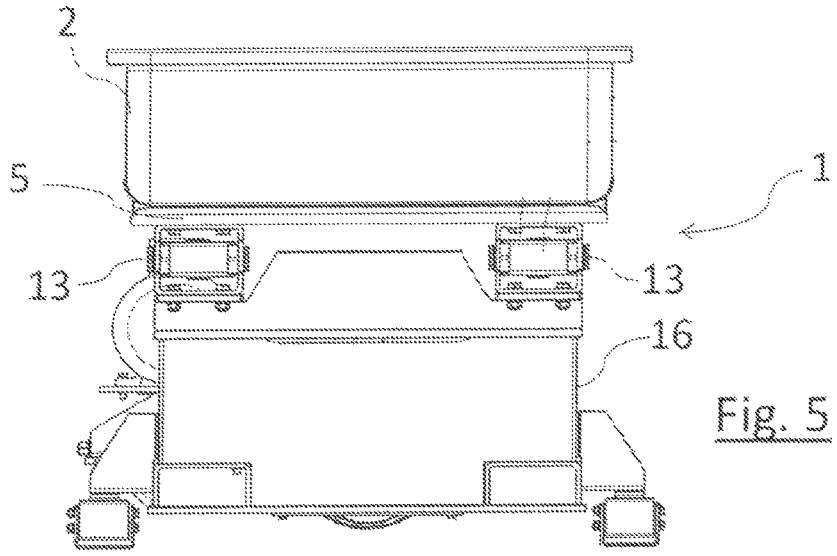
FIG. 5 is an enlarged rear view of the apparatus of the previous FIGS. 1 to 4.

Furthermore, the support system 4 basically comprises [FIGS. 2, 3 and 4] at least three, and preferably four, rocker arms 12, each:

having one end hinged to the tub 2 by means of a plate 5, having the other end hinged to a counterweight 6 located opposite to the tub 2 and being hinged in the middle to a load-bearing structure 16.

Advantageously, the hinges (13,14, 15) for connection of the rocker arms 12 to the tub 2, the counterweight 6 and the structure 16 are viscoelastic hinges.

The slider-crank mechanism 2 acts upon the counterweight 6 to impart a substantially vertical oscillation thereto. Due to the particular configuration of the support system 4, such oscillation is transferred to the tub 2.

As a result of the above: if the mass of the counterweight 6 is appropriately selected to be as close as possible to the mass of the tub 2 and to the mass of the fabrics contained therein, the transfer mechanism 4 will be perfectly dynamically balanced. Furthermore, excepting any difference due to friction and/or elasticity of the hinges, the oscillations of the tub 2 and the counterweight 6 have substantially identical amplitudes.

This will be also obviously true in case of high accelerations, i.e. high inertial reactions possibly caused by fast reversing of the moving parts, as may be designed to occur in the apparatus 1 in its various operating states.

This will provide the advantage—in addition to the other advantages that will be mentioned below—that the slider-crank mechanism 3 is allowed to actuate the support system 4 with a lower effort even with high masses of fabric contained in the tub 2 and/or at high vibration frequencies, that may generally range from 5 to 15 Hz.

The slider-crank mechanism 3—as clearly shown in FIGS. 2, 3, 4—preferably comprises a rotating drive shaft 7 having two pins 8 eccentric to the axis of rotation of the shaft 7, at its opposite ends.

Figure 6:
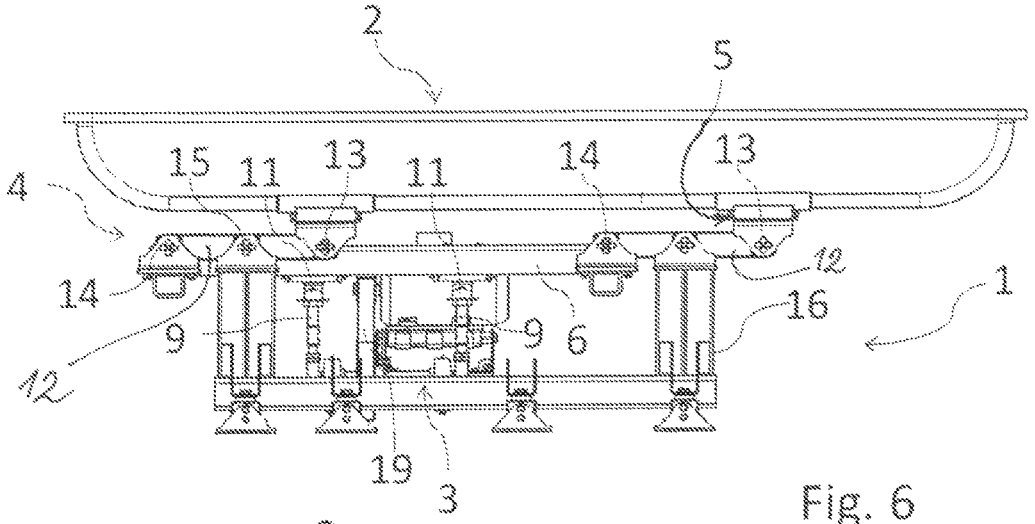
FIG. 6 is an elevational view of the apparatus as a whole.
Figure 7:
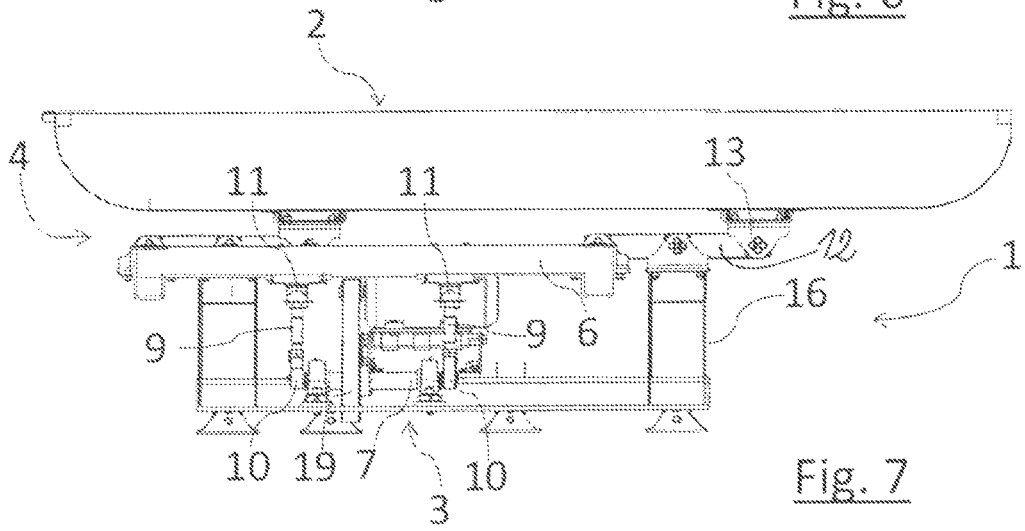
FIG. 7 is a longitudinal sectional view of the apparatus.

The mechanism 3 also includes two substantially vertically-extending connecting rods 9, each having a head 10 for connection with the corresponding eccentric pin 8, and an articulated foot 11, which is associated in elastically compliant fashion to the counterweight 6—as clearly shown in FIGS. 6 and 7. The foot 11 advantageously consists of an elastic hinge, analogous to the above described hinges 13-15.

The shaft 7 is rotated by means of a transmission 18 comprising a motor 22, a pair of pulleys 20, 21 and a belt 19.

As a result, the mechanism 3 can impart oscillations with a prevailing vertical component to the counterweight 6.

The movements received by the counterweight 6 are then transferred, through the support system 4, to the tub 2 and finally from the latter to the fabric contained therein.

An apparatus according to the invention can fully achieve the purposes of treating large amounts of fabric, and imparting wider ranges of vibrational frequencies to fabrics. This will afford advantages over the prior art, consisting in significant throughput enhancement without the need of increasing the size of the structures of the physical apparatus and its actuation and control mechanisms; and in a wider choice of the most suitable frequencies for optimized treatment, and/or for the various types of fabrics to be treated from time to time.

The invention claimed is:

1. A vibrating apparatus for dimensional stabilization treatment of fabrics, comprising:

a fabric-containing tub; and a vibration-generating slider-crank mechanism and a support mechanism for supporting the tub and transferring vibrations produced by the vibration generating mechanism, wherein said vibration-generating mechanism comprises at least one rotating drive shaft having at least one pin eccentric to the axis of rotation of the shaft, said vibration generating mechanism including a vertically extending connecting rod corresponding to said one or each eccentric pin, and having a head connected to the eccentric pin and a foot elastically connected to a counterweight such that said vibration generating mechanism transfers vertical oscillatory movements of the eccentric pin to the counterweight and the movements are transferred from the counterweight through the support mechanism to the tub and the fabric;

wherein said tub is made of carbon fiber.

2. An apparatus as claimed in claim 1, wherein said support mechanism for supporting and transferring vibrations comprises at least three rocker arms, each rocker arm:

having one end hinged to the tub, having an other end hinged to the counterweight, the counterweight being located opposite to the tub, and each rocker arm being hinged in a middle portion to a load-bearing structure.

3. An apparatus as claimed in claim 2, wherein the hinges for connection of the rocker arms to the tub, the counterweight and the load-bearing structure are viscoelastic hinges.

4. An apparatus as claimed in claim 1, comprising a mechanical transmission, which has a belt fitted in a closed loop around a pair of pulleys, one pulley of which is connected to said shaft, the other pulley being connected to a motor for driving the apparatus.

5. An apparatus as claimed in claim 1, wherein the counterweight has a mass dynamically balanced to a mass of the tub and the fabric contained in the tub.

6. An apparatus as claimed in claim 1, wherein the counterweight has a mass imparting an oscillation to the tub, wherein the oscillation of the tub and an oscillation of the counterweight have substantially identical amplitudes.

* * * * *